US005318372A

United States Patent [19]

Besthorne

[11] Patent Number: 5,318,372

[45] Date of Patent: Jun. 7, 1994

[54] COMBINATION PEN AND PENCIL WRITING INSTRUMENT

[76] Inventor: Gerard Besthorne, 22 Augusta St., Irvington, N.J. 07111

[21] Appl. No.: 595,993

[22] Filed: Oct. 11, 1990

[51] Int. Cl.[5] ..... B43K 27/02; B43K 29/02

[52] U.S. Cl. ..... 401/19; 401/20; 401/34; 401/35; 15/105.51; 15/427

[58] Field of Search ..... 401/34, 35, 20, 19, 401/18; 15/105.51, 424, 427, 428

[56] References Cited

U.S. PATENT DOCUMENTS

| | | | |
|---|---|---|---|
| 35,467 | 6/1862 | Oliver | 15/428 |
| 447,873 | 3/1891 | Hanimann | 15/427 |
| 536,935 | 4/1895 | McIntyre | 15/105.51 |
| 1,395,793 | 11/1921 | Broschart | 401/6 |
| 1,598,873 | 9/1926 | Peterson | 401/6 |

FOREIGN PATENT DOCUMENTS

| | | | |
|---|---|---|---|
| 798472 | 5/1936 | France | 401/34 |
| 961464 | 5/1950 | France | 401/34 |
| 26918 | 5/1916 | Norway | 401/20 |

*Primary Examiner*—Steven A. Bratlie
*Attorney, Agent, or Firm*—Richard L. Miller

[57] ABSTRACT

A combination pen and pencil writing instrument is provided and consists of a connector member for joining the distal ends of a ball-point pen and a lead pencil together, so that a person using the writing instrument can use the ball-point pen or lead pencil for writing, drawing and marking.

2 Claims, 1 Drawing Sheet

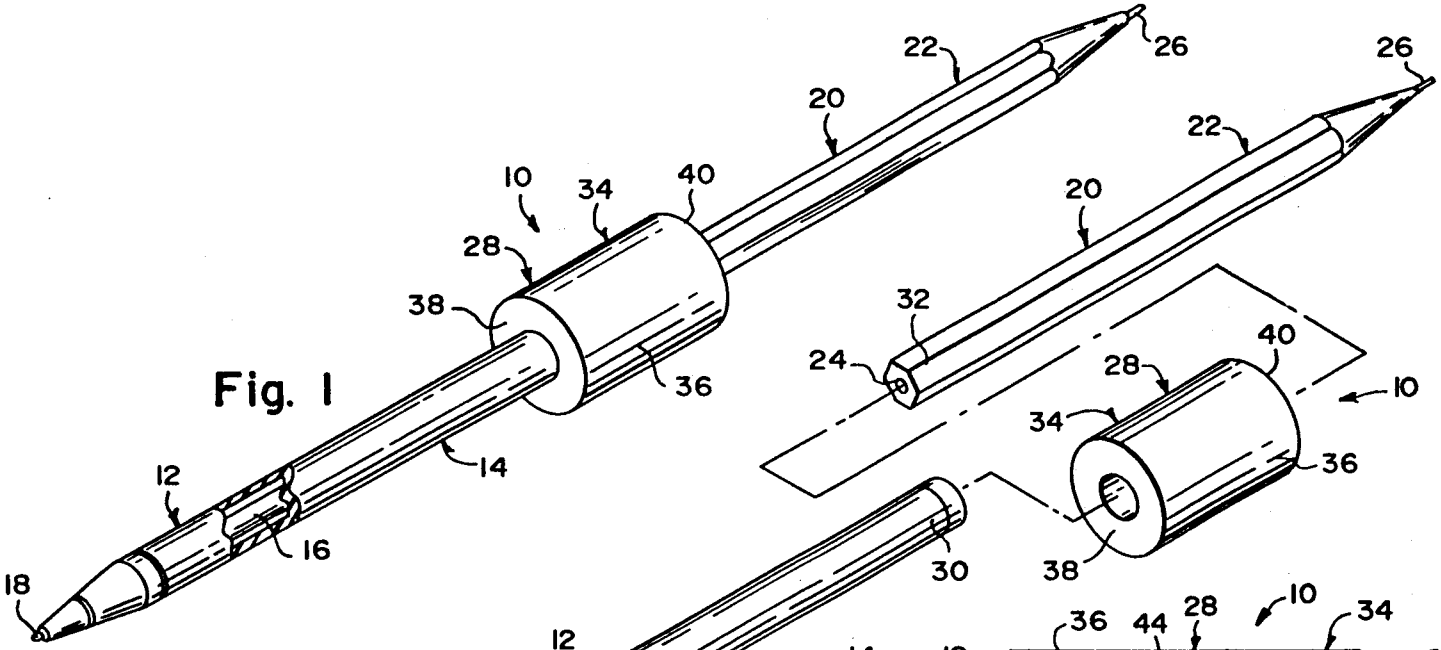
Fig. 1
Fig. 2
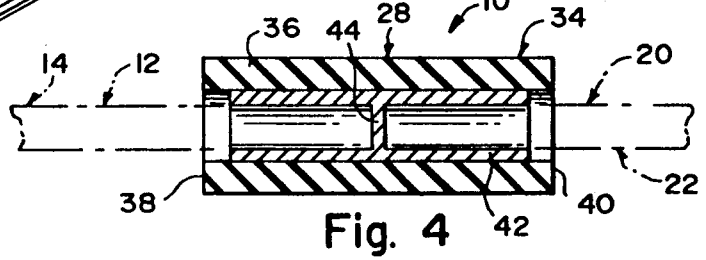
Fig. 4
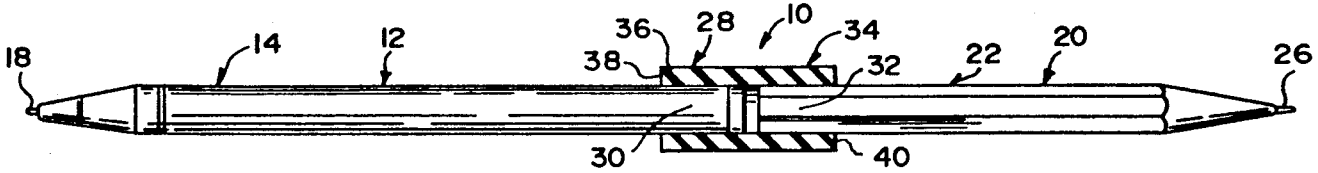
Fig. 3

COMBINATION PEN AND PENCIL WRITING INSTRUMENT

BACKGROUND OF THE INVENTION

The instant invention relates generally to a combination pen and pencil writing instrument.

Numerous writing implements have been provided in the prior art that are adapted to utilize the writing qualities of a pen and pencil together in one instrument. For example, U.S. Pat. Nos. 1,334,860 to Hughes; U.S. Pat. No. 1,463,983 to Visitacion and U.S. Pat. No. 1,508,090 to Detrick all are illustrative of such prior art. While these units may be suitable for the particular purpose to which they address, they would not be as suitable for the purpose of the present invention as hereafter described.

SUMMARY OF THE INVENTION

A primary object of the present invention is to provide a combination pen and pencil writing instrument that will overcome the shortcomings of the prior art devices.

Another object is to provide a combination pen and pencil writing instrument in which a connector member joins the distal end of a ball-point pen to the distal end of a lead pencil so that the ball-point pen or the lead pencil can be utilized by a person using the writing instrument.

An additional object is to provide a combination pen and pencil writing instrument in which the ball-point pen can be separated from the connector member which is fabricated out of rubber, so that the connector member can now be used as a pencil eraser for the lead pencil.

A further object is to provide a combination pen and pencil writing instrument that is simple and easy to use.

A still further object is to provide a combination pen and pencil writing instrument that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the instant invention ready for use;

FIG. 2 is an exploded perspective view thereof;

FIG. 3 is a cross sectional view taken through the length of the connector member of the instant invention; and FIG. 4 is a cross sectional view of a modification showing the connector member having a rigid inner sleeve for holding the distal ends of the pen and pencil firmly therein.

DETAILED DESCRIPTION OF THE PREFERRED EMBODIMENTS

Turning now descriptively to the drawings, in which like reference characters denote like elements throughout the several views, the FIGS. illustrate a combination pen and pencil writing instrument 10 consisting of a ball-point pen 12 having an elongated barrel 14 and an internal ink cartridge 16 with a ball bearing writing tip 18. A lead pencil 20 also provided having an elongated casing 22 and an internal thin graphite rod 24 with a writing point 26. A mechanism 28 is for joining the distal end 30 of the barrel 14 of the ball-point pen 12 and the distal end 32 of the casing 22 of the lead pencil 20 together. A person can use in one instance the ball bearing tip 18 of the ball-point pen 12 and in another instance the writing point 26 of the lead pencil 20 for writing, drawing and marking.

The joining mechanism 28 includes a connector member 34 being a hollow cylindrical collar 36 for receiving the distal end 30 of the barrel 14 of the ball-point pen 12 in one end 38 and the distal end 32 of the casing 22 of the lead pencil 20 in an opposite end 40 thereof. The collar 36 is fabricated out of a flexible rubber material, so that when the distal end 30 of the barrel 14 of the ball-point pen 12 is removed therefrom, the collar 36 can be utilized as a pencil eraser for the lead pencil 20.

As shown in FIG. 4, the connector member 34 can further include a rigid cylindrical sleeve 42 having a transverse separator wall 44 therein. The sleeve 42 is insertable into the collar 36 so that the distal end 30 of the barrel 14 of the ball-point pen 12 and the distal end 32 of the casing 22 of the lead pencil 20 will be held firmly within the sleeve 42 of the connector member 34. The sleeve 42 can be fabricated out of a durable metal, plastic, wood or the like material.

To assemble and use the writing instrument 10, a person will simply insert the distal end 30 of the barrel 14 of the ball-point pen 12 into the connector member 34 and then the distal end 32 of the casing 22 of the lead pencil 20 into the other side of the connector member 34. The person can grip either the barrel 14 or the ball-point pen or the casing 22 of the lead pencil 20 to write, draw and mark with the writing instrument 10.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A combination pen and pencil writing instrument comprising:

a) a ball-point pen having an elongate barrel and an internal ink cartridge with a ball bearing writing tip;

b) a lead pencil having a elongate casing and an internal thin graphite rod with a writing point; and c) means for joining the distal end of the barrel of said ball-point pen and the distal end of the casing of said lead pencil together to extend colinearly in opposite directions, the joining means comprising a connector member, being a hollow cylindrical collar fabricated out of a flexible rubber material and receiving the distal end of the barrel of said ball-point pen in one end and the distal end of the casing of said lead pencil in an opposite end thereof, so that a person can use, in one instance, the ball bearing writing tip of said ball point pen and, in another instance, the writing point of said lead pencil for writing, drawing and marking by simply reversing the direction of the instrument and so that, when the distal end of the barrel of said ball-point pen is removed therefrom, said collar can be utilized as a pencil eraser for said lead pencil, wherein said connector member further includes a rigid cylindrical sleeve having a transverse separator wall therein, said sleeve is insertable into said collar so that the distal end of the barrel of said ball-point pen and the distal end of the casing of said lead pencil will be held firmly within said sleeve of said connector member.

2. A combination pen and pencil writing instrument as recited in claim 1, wherein said sleeve is fabricated out of a durable material.

* * * * *